US006652047B1

(12) United States Patent
Maguire, Jr.

(10) Patent No.: US 6,652,047 B1
(45) Date of Patent: Nov. 25, 2003

(54) DEVICE FOR STORING PILLS AND INDICATING QUANTITY OF THE PILLS TO BE TAKEN AT TIMES SPECIFICALLY INDICATED THEREON

(76) Inventor: Peter C. Maguire, Jr., 14 Auburn Dr., Greenlawn, NY (US) 11740

( * ) Notice: Subject to any disclaimer, the term of this patent is extended or adjusted under 35 U.S.C. 154(b) by 112 days.

(21) Appl. No.: 09/925,518

(22) Filed: Aug. 9, 2001

(51) Int. Cl.[7] ..... B65D 83/04

(52) U.S. Cl. ..... 312/209; 312/245; 312/300; 206/534

(58) Field of Search ..... 312/245, 234.3, 312/246, 300, 321.5, 270.2, 209; 206/534, 538, 528

(56) References Cited

U.S. PATENT DOCUMENTS

| | | | | | |
|---|---|---|---|---|---|
| 1,539,296 | A | * | 5/1925 | Bundy et al. | 312/300 |
| 3,246,940 | A | * | 4/1966 | Karper | 312/300 |
| 3,584,598 | A | * | 6/1971 | Gayle et al. | 206/534 |
| 3,630,171 | A | * | 12/1971 | Huck | 206/534 |
| 3,638,603 | A | * | 2/1972 | Conover | 312/234 |
| 3,773,250 | A | * | 11/1973 | Phillips | 206/538 |
| 3,897,855 | A | * | 8/1975 | Patterson | 312/209 |
| 3,926,335 | A | | 12/1975 | Dangles et al. | |
| 3,988,909 | A | * | 11/1976 | Catapano | 312/209 |
| 4,204,611 | A | | 5/1980 | Graves | |
| 4,349,338 | A | * | 9/1982 | Heppler | 312/209 |
| 4,572,376 | A | | 2/1986 | Wrennall | |
| 5,322,166 | A | | 6/1994 | Crowther | |
| 5,421,252 | A | * | 6/1995 | Reichel | 220/909 |
| 5,740,909 | A | * | 4/1998 | Nazare et al. | 206/366 |
| 5,954,225 | A | * | 9/1999 | Powe | 206/534 |
| 6,464,506 | B1 | * | 10/2002 | Welles | 206/534 |

FOREIGN PATENT DOCUMENTS

| | | | | |
|---|---|---|---|---|
| DE | 3321549 | * | 12/1984 | 312/300 |
| DE | 3530356 | * | 8/1986 | 206/534 |
| GB | 2275180 | * | 8/1994 | 312/270.2 |

* cited by examiner

*Primary Examiner*—Lanna Mai
*Assistant Examiner*—Hanh V. Tran
(74) *Attorney, Agent, or Firm*—Richard L. Miller

(57) ABSTRACT

A device for storing pills and indicating quantity of the pills to be taken at times specifically indicated thereon that includes a housing and a dial rotatably mounted to the housing. The housing has a plurality of drawers for storing different pills. The dial includes an axle that is rotatably mounted along the top of the housing, a pair of end caps that are disposed over the pair of ends of the axle, respectively, quantity indica disposed in line along the axle and aligned with the drawers, respectively, and time indica that are disposed on the longitudinal side wall of each end cap and aligned with the quantity indica associated with that time so as the dial is rotated to the specific time indica, the quantity india in line therewith indicates quantity of the pills to be taken from the drawers aligned therewith.

19 Claims, 1 Drawing Sheet

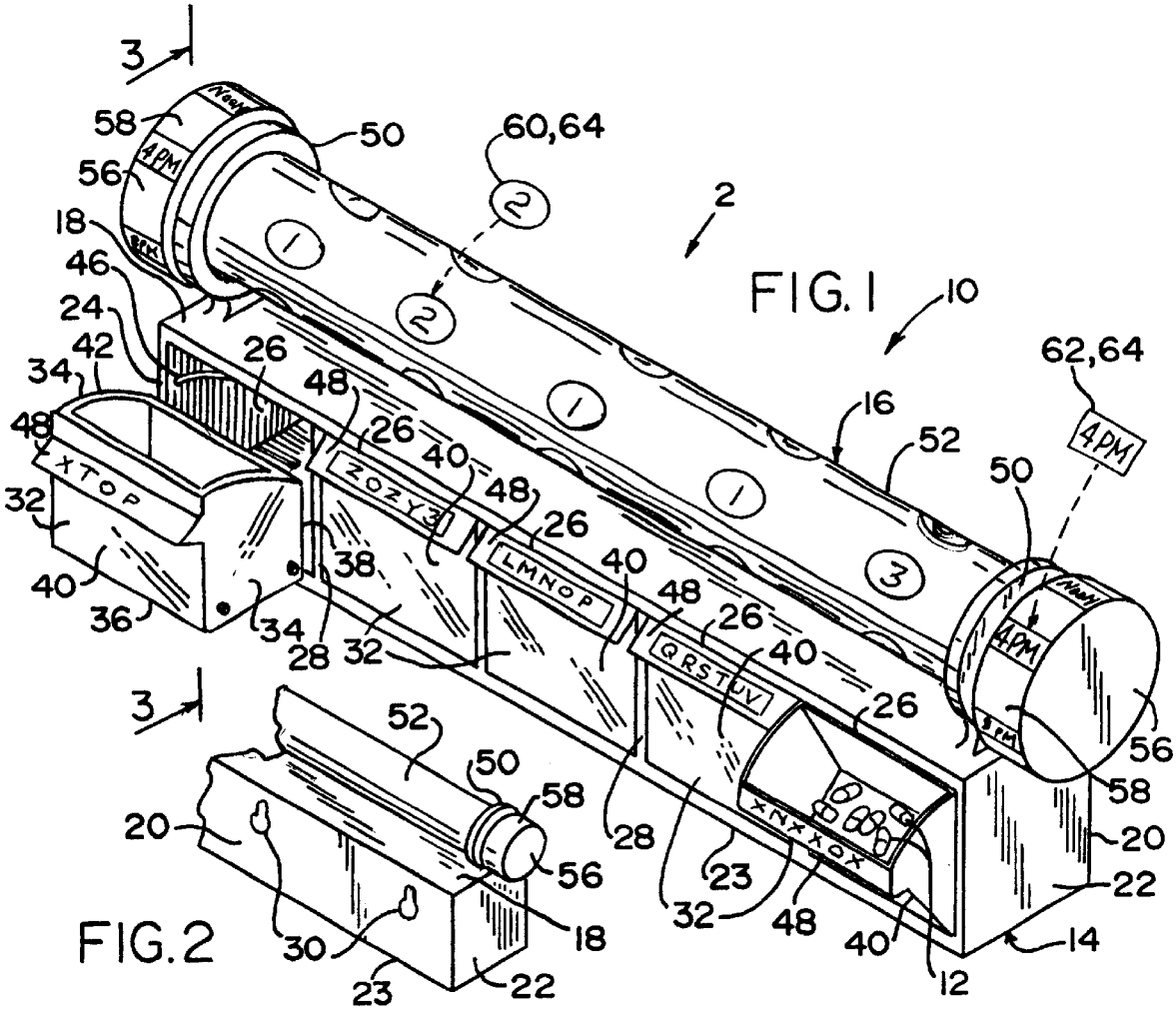
FIG. 1
FIG. 2
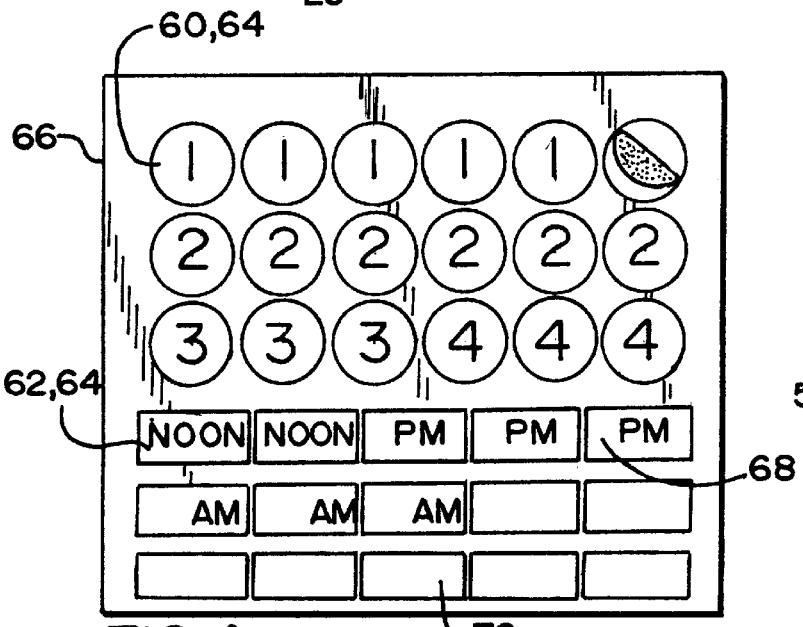
FIG. 4
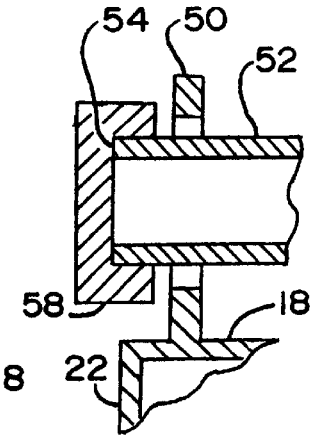
FIG. 3

DEVICE FOR STORING PILLS AND INDICATING QUANTITY OF THE PILLS TO BE TAKEN AT TIMES SPECIFICALLY INDICATED THEREON

BACKGROUND OF THE INVENTION

1. Field of the Invention

The present invention relates to a device for storing pills. More particularly, the present invention relates to a device for storing pills and indicating quantity of the pills to be taken at times specifically indicated thereon.

2. Description of the Prior Art

Numerous innovations for pill storage devices have been provided in the prior art that will be described. Even though these innovations may be suitable for the specific individual purposes to which they address, however, they differ from the present invention.

A FIRST EXAMPLE U.S. Pat. No. 3,926,335 to Dangles et al. teaches a pill dispensing container having upper and lower pill storage tiers each having twelve radial pill storage compartments each having an embossed hour indicia of the day for 24 hour use. Each tier is covered by a rotatable dial cover having a generally horizontal opening for pill insertion and a vertical opening for pill discharge clockwise one compartment of the horizontal opening. Each tier has a tier rotating tab on the horizontal surface of the tier dial cover adjacent the horizontal opening and a tier stop permitting only clockwise movement of the tier dial cover and being on the underside of each dial cover horizontal surface adjacent the tab and horizontal opening. A pair of pedestal members project from the vertical side of the container base below the lower tier for supporting at right angles to the pill dispensing position in balanced condition the dispenser container in a general vertical storage position so as to view the indicia in vertical elevation on the slope bottom walls of each tier.

A SECOND EXAMPLE U.S. Pat. No. 4,204,611 to Graves teaches a product dispenser for dispensing products, such as tablets, on a time related schedule, or randomly as desired, comprising a generally cylindrical product receiving magazine having a plurality of axially spaced groups of circumferentially spaced, radially outwardly opening, product receiving pockets which are generally in axial alignment with the pockets of adjacent groups to form circumferentially spaced rows of pockets; a plurality of product retaining rotatable rings mounted on the magazine in radial alignment with the pockets for retaining the tablets in the pockets; each ring including a tablet dispensing aperture therethrough adapted to be moved into alignment with a selected one of the pockets; a plurality of axially spaced indicia, representing the days of the week, lying in the planes of the groups of pockets; and circumferentially spaced indicia, representing different time periods throughout the day, generally longitudinally aligned with the rows of pockets.

A THIRD EXAMPLE U.S. Pat. No. 4,572,376 to Wrennall teaches a dial pill box that comprises a container having 28 arcuate storage compartments for pills and the like, a pair of lids, and a central pivot pin which pivotably holds together the container and the lids. The pivot pin enables the containers to be assembled by snapping the lids onto the container and over the pivot pin and to be disassembled by pinching together the resiliently bifurcated ends of the pivot pin and pushing these ends toward the lids and through their central holes. After removing both lids, a user can fill the container with a week's supply of pills, capsules, tablets, and the like of pharmaceuticals, vitamins, and/or minerals. He can spin the upper lid independently of the lower lid in one direction, so that none of the four segment apertures in the upper lid coincide with the access sector of the lower lid, whereby the dial pill box is in position for storage and transportation. By spinning both lids together in the opposite direction, the user can place the access sector in the lower lid over a selected storage sector, having four storage compartments, which is marked for the desired day of the week. By then spinning the upper lid again in the first direction, he can spirally place a selected segment aperture, corresponding to the selected time of day, over the access sector and then remove the pills therefrom.

A FOURTH EXAMPLE U.S. Pat. No. 5,322,166 to Crowther teaches a pill storage and dispensing container that has a lower storage unit with a plurality of radially arranged individual pill storage compartments. An upper storage unit positioned directly above and nestled within the lower unit also has a plurality of similarly arranged storage compartments as well as one bottomless compartment. A top cover is positioned directly above the upper storage unit, and a dispensing opening in the cover is arranged to communicate with the various compartments in the upper unity as well as with the bottomless compartment and the various compartments of the lower storage unity as the cover is rotated relative to the storage units. A hub shaft releasably interconnects the upper and lower storage units and the top cover while allowing the storage units and cover to rotate relative to one another. Twenty-eight individual storage compartments are provided in a compact container which enables pills to be dispensed four times per day over a seven day period.

It is apparent that numerous innovations for pill storage devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a device for storing pills and indicating quantity of the pills to be taken at times specifically indicated thereon that avoids the disadvantages of the prior art.

ANOTHER OBJECT of the present invention is to provide a device for storing pills and indicating quantity of the pills to be taken at times specifically indicated thereon that is simple and inexpensive to manufacture.

STILL ANOTHER OBJECT of the present invention is to provide a device for storing pills and indicating quantity of the pills to be taken at times specifically indicated thereon that is simple to use.

BRIEFLY STATED, STILL YET ANOTHER OBJECT of the present invention is to provide a device for storing pills and indicating quantity of the pills to be taken at times specifically indicated thereon that includes a housing and a dial rotatably mounted to the housing. The housing has a plurality of drawers for storing different pills. The dial includes an axle that is rotatably mounted along the top of the housing, a pair of end caps that are disposed over the pair of ends of the axle, respectively, quantity indica disposed in line along the axle and aligned with the drawers, respectively, and time indica that are disposed on the longitudinal side wall of each end cap and aligned with the quantity indica associated with that time so as the dial is rotated to the specific time indica, the quantity india in line therewith indicates quantity of the pills to be taken from the drawers aligned therewith.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 1 is a diagrammatic perspective view of the present invention;

FIG. 2 is a reduced fragmented diagrammatic perspective view taken generally in the direction of arrow 2 in FIG. 1 of the wall mounting apparatus of the present invention;

FIG. 3 is a diagrammatic cross sectional view taken on line 3—3 in FIG. 1 of the dial mounting apparatus of the present invention; and FIG. 4 is a diagrammatic top plan view of the sheet of peel-off stickers of the present invention selectively utilized on the dial of the present invention.

LIST OF REFERENCE NUMERALS UTILIZED IN THE DRAWING

10 device of present invention for storing pills 12 and indicating quantity of pills 12 to be taken at times specifically indicated thereon
12 pills
14 housing for storing pills 12
16 dial for indicating quantity of pills 12 to be taken at times specifically indicated thereon
18 top wall of housing 14
20 back wall of housing 14
22 pair of end walls of housing 14
23 bottom wall of housing 14
24 front of housing 14
26 plurality of side-by-side compartments 26 in housing 14
28 plurality of partitions dividing housing 14 into plurality of side-by-side compartments 26
30 keyholes through back wall 20 of housing 14 for mounting housing 14 on wall (not shown)
32 plurality of drawers pivotally and releasably mounted in plurality of side-by-side compartments in housing 14 for storing different pills 12
34 pair of side walls of each drawer 32 of plurality of drawers
36 bottom wall of each drawer 32 of plurality of drawers
38 back wall of each drawer 32 of plurality of drawers
40 front wall of each drawer 32 of plurality of drawers
42 top of each drawer 32 of plurality of drawers
44 pair of pins extending outwardly from each side wall of pair of side walls 34 of each drawer of plurality of drawers 32
46 tracks on opposing sides of each partition of plurality of partitions 28 in housing 14 and facing sides of pair of end walls 22 of housing 14
48 lip extending horizontally across front wall 40 of each drawer of plurality of drawers 32 for grasping by user to assist pivoting each drawer of plurality of drawers 32 outwardly for accessing pills 12 therein
50 pair of rings of dial 16
52 axle of dial 16
54 pair of ends of axle 52 of dial 16
56 pair of end caps of dial 16 for allowing grasping by user for rotating of axle 52 of dial 16
58 longitudinal side wall of each end cap of pair of end caps 56 of dial 16
60 quantity indica of dial 16
62 time indica of dial 16
64 peel-off stickers releasable from sheet 66
66 sheet
68 blank space before pre-marked "AM" and "PM" on peel-off stickers 64 of time indica 62 for marking time thereon
70 blank stickers of peel-off stickers 64 for having name of pills 12 marked thereon and positioned on lip 48 of drawers 32 for identifying pills 12 therein

DETAILED DESCRIPTION OF THE PREFERRED EMBODIMENT

Referring now to the figures, in which like numerals indicate like parts, and particularly to FIG. 1, the device of the present invention is shown generally at 10 for storing pills 12 and indicating quantity of the pills 12 to be taken at times specifically indicated thereon.

The overall configuration of the device 10 can best be seen in FIG. 1, and as such, will be discussed with reference thereto.

The device 10 comprises a housing 14 for storing the pills 12 and a dial 16 that is rotatably mounted to the housing 14 and is for indicating the quantity of the pills 12 to be taken at the times specifically indicated thereon.

The specific configuration of the housing 14 can best be seen in FIGS. 1 and 2, and as such, will be discussed with reference thereto.

The housing 14 is rectangular-parallelepiped-shaped, and has a top wall 18, a back wall 20, a pair of end walls 22, a bottom wall 23, and a front 24 that is open.

The housing 14 is divided into a plurality of side-by-side compartments 26 by a plurality of partitions 28.

The plurality of partitions 28 are parallel to each other, equally spaced-apart form each other, parallel to the pair of end walls 22 of the housing 14, and extend vertically from the bottom wall 23 of the housing 14 to the top wall 18 of the housing 14, and horizontally from the back wall 20 of the housing 14 to the front 24 of the housing 14.

The back wall 20 of the housing 14 has keyholes 30 therethrough for mounting the housing 14 on a wall (not shown).

The housing 14 further has a plurality of drawers 32 that are pivotally and releasably mounted in the plurality of side-by-side compartments 26, respectively, each of the plurality of drawers are for storing different pills 12.

Each drawer 32 has a pair of side walls 34, a bottom wall 36, a back wall 38, a front wall 40, and a top 42 that is open.

Each side wall 34 of each drawer 32 has a pair of pins 44 that extend outwardly therefrom, are disposed just above the bottom wall 36, and just inwardly of the front wall 40 and the back wall 38, respectively.

The pair of pins 44 engage in tracks 46 on opposing sides of an associated partition 28 and facing sides of the pair of end walls 22, respectively, so as to allow the plurality of drawers 32 to pivot outwardly from the plurality of side-by-side compartments 26 for accessing the pills 12 and to be releasable from the plurality of side-by-side compartments 26 for cleaning.

The front wall 40 of each drawer 32 has a lip 48 that extends horizontally thereacross for grasping by a user to assist pivoting the drawer 32 outwardly for accessing the pills 12.

The specific configuration of the dial 16 can best be seen in FIGS. 1–4, and as such, will be discussed with reference thereto.

The dial 16 comprises a pair of rings 50 that extend upwardly from the top wall 18 of the housing 14, are parallel to each other, and are disposed just inward of, and parallel to, the pair of end walls 22 of the housing 14, respectively.

The dial 16 further comprises an axle 52 that is slender, elongated, cylindrically-shaped, extends rotatably in the pair of rings 50, and has a pair of ends 54 that are in vertical alignment with the pair of end walls 22 of the housing 14, respectively.

The dial 16 further comprises a pair of end caps 56 that are disposed over the pair of ends 54 of the axle 52, respectively, for rotation therewith, outboard of the pair of rings 50, respectively, so as to prevent the axle 52 from sliding out of the pair of rings 50, and extend past, and parallel to, the pair of end walls 22 of the housing 14, respectively, for allowing grasping by the user for rotation of the axle 52.

Each end cap 56 is cylindrically-shaped and has a longitudinal side wall 58.

The dial 16 further comprises quantity indica 60 that are disposed in line along the axle 52 and aligned with the drawers 32 containing the pills 12 and being indicative of the quantity of the pills 12 to be taken that are contained in the drawer 32 aligned therewith.

The dial 16 further comprises time indica 62 that are disposed on the longitudinal side wall 58 of each end cap 56, are indicative of the time the pills 12 are to be taken, and are aligned with the quantity indica 60 associated with that time so as the dial 16 is rotated to the specific time indica 62, the quantity india 60 in line therewith indicates the quantity of the pills 12 to be taken from the drawers 32 aligned therewith.

The quantity indica 60 and the time indicia 62 are on peel-off stickers 64 for convenience and customizing and are releasable from a sheet 66.

The peel-off stickers 64 of the quantity indica 60 are pre-marked with sets of numbers from 1–4, respectively.

The peel-off stickers 64 of the time indica 62 are pre-marked with sets of "noon", "AM", and "PM", respectively.

Each peel-off sticker 64 of the time indica 62 that is pre-marked with "AM" and "PM" has a blank space 68 therebefore for marking the time thereon.

The peel-off stickers 64 of the quantity indica 60 are circular-shaped to distinguish them from the peel-off stickers 64 of the time indica 62 that are rectangular-shaped.

The peel-off stickers 64 further include blank stickers 70 for having the name of the pills 12 marked thereon and positioned on the lip 48 of the drawers 32 for identifying the pills 12 therein.

It will be understood that each of the elements described above, or two or more together, may also find a useful application in other types of constructions differing from the types described above.

While the invention has been illustrated and described as embodied in a device for storing pills and indicating quantity of the pills to be taken at times specifically indicated thereon, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed is:

1. A device for storing pills and indicating quantity of the pills to be taken at times specifically indicated thereon, said device comprising:

a) a housing; and b) a dial;

wherein said housing is for storing the pills;

wherein said dial is rotatably mounted to said housing; and wherein said dial is for indicating the quantity of the pills to be taken at the times specifically indicated thereon, wherein said housing is rectangular-parallepiped-shaped;

wherein said housing has a top wall;

wherein said housing has a back wall;

wherein said housing has a pair of end walls;

wherein said housing has a bottom wall;

wherein said housing has a front; and wherein said front of said housing is open, wherein said housing is divided into a plurality of side-by-side compartments by a plurality of partitions, wherein said housing has a plurality of drawers;

wherein said plurality of drawers are pivotally mounted in said plurality of side-by-side compartments, respectively;

wherein said plurality of drawers are releasably mounted in said plurality of side-by-side compartments, respectively; and wherein each of said plurality of drawers are for storing different pills.

2. The device as defined in claim 1, wherein said plurality of partitions are parallel to each other;

wherein said plurality of partitions are equally spaced-apart from each other;

wherein said plurality of partitions are parallel to said pair of end walls of said housing;

wherein said plurality of partitions extend vertically from said bottom wall of said housing to said top wall of said housing; and wherein said plurality of partitions extend horizontally from said back wall of said housing to said front of said housing.

3. The device as defined in claim 1, wherein said back wall of said housing has keyholes therethrough; and wherein said keyholes through said back wall of said housing are for mounting said housing on a wall.

4. The device as defined in claim 1, wherein each drawer has a pair of side walls;

wherein each drawer has a bottom wall;

wherein each drawer has a back wall;

wherein each drawer has a front wall;

wherein each drawer has a top; and wherein said top of each drawer is open.

5. The device as defined in claim 4, wherein each side wall of each drawer has a pair of pins;

wherein said pair of pins extend outwardly from each side wall of each drawer;

wherein said pair of pins are disposed just above said bottom wall; and wherein said pair of pins are disposed just inwardly of said front wall and said back wall, respectively.

6. The device as defined in claim 5, wherein said pair of pins engage in tracks on opposing sides of an associated partition and facing sides of said pair of said pair of end walls of said housing, respectively, so as to allow said plurality of drawers to pivot outwardly from said plurality of side-by-side compartments for accessing the pills and to be releasable from said plurality of side-by-side compartments for cleaning.

7. The device as defined in claimed 4, wherein said front wall of each drawer has a lip;

wherein said lip extends horizontally across said front wall of each drawer; and wherein said lip is for grasping by a user to assist pivoting said drawer outwardly for accessing the pills.

8. A device for storing pills and indicating quantity of the pills to be taken at times specifically indicated thereon, said device comprising:

a) a housing; and b) a dial;

wherein said housing is for storing the pills;

wherein said dial is rotatably mounted to said housing; and wherein said dial is for indicating the quantity of the pills to be taken at the times specifically indicated thereon, wherein said housing is rectangular-parallelpiped-shaped;

wherein said housing has a top wall;

wherein said housing has a back wall;

wherein said housing has a pair of end walls;

wherein said housing has a bottom wall;

wherein said housing has a front; and wherein said front of said housing is open, wherein said dial comprises a pair of rings;

wherein said pair of rings extend upwardly from said top wall of said housing;

wherein said pair of rings are parallel to each other;

wherein said pair of rings are disposed just inward of said pair of end walls of said housing, respectively, and wherein said pair of rings are parallel to said pair of end walls of said housing.

9. The device as defined in claim 8, wherein said dial comprises an axle;

wherein said axle is slender;

wherein said axle is elongated;

wherein said axle is cylindrically-shaped;

wherein said axle extends rotatably in said pair of rings;

wherein said axle has a pair of ends; and wherein said pair of ends of said axle are in vertical alignment with said pair of end walls of said housing, respectively.

10. The device as defined in claim 9, wherein said dial comprises a pair of end caps;

wherein said pair of caps are disposed over said pair of ends of said axle, respectively;

wherein said pair of ends caps rotate with said axle;

wherein said pair of ends caps are disposed outboard of said pair of rings, respectively, so as to prevent said axle from sliding out of said pair of rings;

wherein said pair of ends caps are parallel to said pair of end walls of said housing; and wherein said pair of ends caps extend past said pair of end walls of said housing, respectively, for allowing grasping by the user for rotation of said axle.

11. The device as defined in claim 10, wherein each end cap is cylindrically-shaped; and wherein each end cap has a longitudinal side wall.

12. The device as defined in claim 11, wherein said dial comprises quantity indica;

wherein said quantity indicia are disposed in line along said axle;

wherein said quantity indicia are aligned with said drawers, respectively; and wherein said quantity indicia is indicative of quantity of the pills to be taken that are contained in said drawer aligned therewith.

13. The device as defined in claim 12, wherein said dial comprises time indica;

wherein said time indicia are disposed on said longitudinal side wall of each end cap;

wherein said time indicia are indicative of time the pills are to be taken; and wherein said time indicia are aligned with said quantity indica associated with that time so as said dial is rotated to said specific time indica, said quantity india in line therewith indicates quantity of the pills to be taken from said drawers aligned therewith.

14. The device as defined in claim 13, wherein said quantity indica and said time indicia are on peel-off stickers;

wherein said peel-off stickers are for convenience and customizing; and wherein said peel-off stickers are releasable from a sheet.

15. The device as defined in claim 14, wherein said peel-off stickers of said quantity indica are pre-marked with sets of numbers from 1–4, respectively.

16. The device as defined in claim 14, wherein said peel-off stickers of said time indica are pre-marked with sets of "noon", "AM", and "PM", respectively.

17. The device as defined in claim 16, wherein each peel-off sticker of said time indica that are pre-marked with "AM" and "PM" has a blank space therebefore;

and wherein said blank space is for marking the time thereon.

18. The device as defined in claim 14, wherein said peel-off stickers of said quantity indica are circular-shaped to distinguish them from said peel-off stickers of said time indica that are rectangular-shaped.

19. The device as defined in claim 14, wherein said peel-off stickers include blank stickers;

wherein said blank stickers are for having name of the pills marked thereon; and wherein said blank stickers are positioned on said lip of said drawers for identifying the pills therein.

* * * * *